US007327965B2

(12) United States Patent
Ino

(10) Patent No.: US 7,327,965 B2
(45) Date of Patent: Feb. 5, 2008

(54) CHARGING UNITS CAPABLE OF USE IN AND IMAGE FORMING APPARATUS HAVING DIFFERENT PROCESSING SPEEDS

(75) Inventor: Toshiaki Ino, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 147 days.

(21) Appl. No.: 11/090,268

(22) Filed: Mar. 28, 2005

(65) Prior Publication Data

US 2005/0226644 A1 Oct. 13, 2005

(30) Foreign Application Priority Data

Mar. 29, 2004 (JP) ..... 2004-095915

(51) Int. Cl.
*G03G 15/02* (2006.01)

(52) U.S. Cl. ..... 399/50; 399/168

(58) Field of Classification Search ..... 399/50, 399/168; 361/225

See application file for complete search history.

(56) References Cited

U.S. PATENT DOCUMENTS

| | | | | |
|---|---|---|---|---|
| 5,539,501 | A * | 7/1996 | Yu et al. | 399/171 |
| 5,581,331 | A * | 12/1996 | Teshigawara et al. | 399/171 |
| 5,613,172 | A * | 3/1997 | Pietrowski et al. | 399/50 |
| 6,188,419 | B1 * | 2/2001 | Katamoto et al. | 347/129 |
| 6,549,733 | B2 * | 4/2003 | Matsuguma | 399/26 |
| 6,962,746 | B2 * | 11/2005 | Taniguchi et al. | 428/323 |
| 2001/0043817 | A1 * | 11/2001 | Maebashi | 399/50 |
| 2004/0265006 | A1 * | 12/2004 | Taniguchi et al. | 399/174 |
| 2006/0051137 | A1 * | 3/2006 | Murata et al. | 399/277 |

FOREIGN PATENT DOCUMENTS

| | | | |
|---|---|---|---|
| JP | 02220070 | A * | 9/1990 |
| JP | 08220844 | A * | 8/1996 |
| JP | 10149075 | A * | 6/1998 |
| JP | 2000242057 | A * | 9/2000 |
| JP | 2000330362 | A * | 11/2000 |
| JP | 2002-229302 | A | 8/2002 |
| JP | 2003-191526 | A | 7/2003 |
| JP | 2003-280314 | A | 10/2003 |
| JP | 2003316112 | A * | 11/2003 |
| JP | 2004258106 | A * | 9/2004 |

OTHER PUBLICATIONS

Computer translation of cited reference JP2003-280314a.*

* cited by examiner

*Primary Examiner*—Quana Grainger
(74) *Attorney, Agent, or Firm*—Birch, Stewart, Kolasch & Birch, LLP

(57) ABSTRACT

Charging unit(s) is/are made versatile enough to be used in a plurality of image forming apparatus models having different processing speeds. Furthermore, in the context of an electrophotographic image forming apparatus permits selective switching between/among processing speeds, two charging units 5*a*, 5*a* having mutually identical configuration (e.g., charging units having case width 14 mm) are arranged within a single image forming unit (e.g., black image forming station Sa), the number of these two charging units 5*a*, 5*a* that is/are driven being switched in correspondence to processing speed(s) so as to make it possible for all of the charging units at image forming apparatus 100 to be accommodated by the same model.

6 Claims, 8 Drawing Sheets

Processing speed ≦ 275 mm/s: Case width 14 mm
Processing speed > 275 mm/s: Case width 24 mm

CHARGING UNITS CAPABLE OF USE IN AND IMAGE FORMING APPARATUS HAVING DIFFERENT PROCESSING SPEEDS

BACKGROUND OF INVENTION

This application claims priority under 35 USC 119(a) to Patent Application No. 2004-095915 filed in Japan on 29 Mar. 2004, the content of which is hereby incorporated herein by reference in its entirety.

The present invention relates to a charging unit such as might be employed in a copier, laser printer, facsimile machine, or other such electrophotographic image forming apparatus, and to an image forming apparatus of the type in which corona-type charging unit(s) or other such charging unit(s) is/are used to charge photosensitive body surface(s).

Copiers and other such electrophotographic image forming apparatuses include monochromatic image forming apparatuses which form black-and-white images, and color image forming apparatuses which form a color images. Color image forming apparatuses include multirotational-type image forming apparatuses in which toner images corresponding to respective color components (black, cyan, magenta, and yellow) are sequentially formed on a single photosensitive body by way of toner image forming means for the respective colors, and tandem-type image forming apparatuses in which a plurality of toner image forming means respectively forming toner images corresponding to the respective color components more or less simultaneously on separate photosensitive bodies are arranged in series in the transport direction of a transfer intermediary (see, e.g., Japanese Patent Application Publication Kokai No. 2003-191526).

Moreover, tandem-type image forming apparatuses include apparatuses of the type permitting selection of either a full-color printing mode or a monochromatic printing mode (machines capable of both color and black-and-white). Furthermore, of the machines that are capable of both color and black-and-white printing, there are apparatuses permitting switching between/among processing speeds, it being possible to choose processing speed(s) when carrying out monochromatic printing that is/are faster than the processing speed(s) available when carrying out color printing.

Moreover, as charging units in electrophotographic image forming apparatuses, corotron charging units employing wires and cases, scorotron charging units employing wires (discharge electrodes) and cases together with grid electrodes to stabilize surface potentials at photosensitive bodies, and other such corona-type charging units are frequently used (see, e.g., Japanese Patent Application Publication Kokai No. 2002-229302). In particular, scorotron charging units possess the advantage that arrangement of grid(s) between discharge electrode(s) and photosensitive body surface(s) permits stable control of photosensitive body surface potential(s). However, with corona-type charging units, there is the problem of the ozone emissions that accompany corona discharge.

Moreover, among copiers and other such image forming apparatuses, there are models having different processing speeds, e.g., there are slow machines, fast machines, and so forth; and because charging units have conventionally been designed such that each model has had its own dedicated charging unit(s), this has not only resulted in high cost but has also been a problem in terms of inventory/turnaround.

Furthermore, where it is possible to switch between/among processing speeds in a single color image forming apparatus, to permit faster processing speed(s) when carrying out monochromatic printing as described above, the charging unit(s) used for black have been larger (e.g., corona-type charging unit(s) having larger case width(s)) than the charging unit(s) for the other colors (cyan, magenta, and yellow). This being the case, it has been difficult to make use of common charging unit(s) within the same image forming apparatus. In addition, because frequency of usage of black charging units is high, charging characteristics of black charging units tend to deteriorate rapidly.

SUMMARY OF INVENTION

The present invention was conceived in light of circumstances such as the foregoing, it being an object thereof to provide a charging unit capable of being employed in a plurality of models having different processing speeds as well as an image forming apparatus equipped with one or more of such charging unit(s), and to provide an image forming apparatus reducing to the extent possible the number of model(s) of charging unit(s) charging photosensitive body surface(s).

A charging unit in accordance with one or more embodiments of the present invention is capable of being used in an electrophotographic image forming apparatus, the charging unit being versatile enough to be used in one or more image forming apparatus models having respectively different processing speeds.

A corona-type charging unit is preferably used as the charging unit in such embodiment(s) of the present invention, but a contact-type charging unit utilizing roller charging and/or brush charging may also be used. Furthermore, where a corona-type charging unit is employed, it is preferred that one or more discharge currents supplied from one or more high-voltage power supplies to the corona-type charging unit be chosen in correspondence to at least one of the processing speeds.

An image forming apparatus in accordance with one or more embodiments of the present invention is equipped with charging unit(s) having feature(s) as described above.

Next, such embodiments of the present invention will be described in detail.

First, as a result of research by the present inventor(s), it was found upon studying the relationship between image forming apparatus processing speed and corona-type charging unit case width (grid width) that, as shown in FIG. 8, (1) a charging unit having a case width Wc of 14 mm could accommodate a wide range of processing speeds, i.e., up to 300 mm/sec; and (2) for processing speeds of 300 mm/sec and higher, it was necessary to use a charging unit having a large case width (e.g., case width Wc=24 mm).

In recognition of points such as these, in embodiment(s) of the present invention, charging unit(s) are made versatile such that a single charging unit configuration (e.g., case width=14 mm) can accommodate a plurality of image forming apparatus models having different processing speeds (e.g., a plurality of image forming apparatus models having processing speeds which are less than or equal to 300 mm/sec).

Moreover, by thus increasing versatility of charging unit (s), it is possible to achieve such benefits as reduction in cost, reduction in inventory, and faster turnaround.

Furthermore, it was found upon studying the relationship between image forming apparatus processing speed and total current which is correlated to discharge current of the corona-type charging unit that results were as shown in FIG. 9. Based upon the results at FIG. 9, where a corona-type charging unit endowed with versatility is employed, it is possible to inhibit excess ozone generation by choosing an appropriate value for the discharge current (total current) supplied to the corona-type charging unit in correspondence to processing speed.

Next, the constitution of another embodiment of the present invention will be described.

An electrophotographic image forming apparatus in accordance with one or more embodiments of the present invention is capable of carrying out one or more image forming processes setting at a plurality of processing speeds; permits selective switching between or among the processing speeds; and comprises one or more image forming units; at least one of the image forming unit or units (e.g., a black image forming station) being such that a plurality of charging units having mutually identical configuration (e.g., charging units having a case width of 14 mm) are arranged therewithin. When driving charging unit(s) in an image forming apparatus in accordance with such embodiment(s) of the present invention, the number of the charging units to be driven may be switched in correspondence to processing speed.

In the case of, for example, a tandem-type full-color apparatus, an image forming apparatus in accordance with such embodiment(s) of the present invention might be such that two charging units are employed for black, one charging unit having a case width of 14 mm being driven during color printing (e.g., processing speed=220 mm/sec (30 pages/min)), and two charging units having case widths of 14 mm being driven in parallel during monochromatic printing (e.g., processing speed=330 mm/sec (45 pages/min)); such that the same model of charging unit is capable of accommodating a plurality of processing speeds, i.e., the processing speed existing during color printing and the faster processing speed existing during monochromatic printing.

In an image forming apparatus in accordance with such embodiment(s) of the present invention, at least a portion of the charging units may be versatile enough to be used in at least one other model of image forming apparatus having at least one different processing speed. By thus increasing versatility of charging unit(s), it is possible to achieve such benefits as reduction in cost, reduction in inventory, and faster turnaround. Note, moreover, that ability to employ charging unit(s) in other image forming apparatus model(s) having different processing speed(s) is for reasons similar to the content of the aforementioned studies (FIG. 8).

In an image forming apparatus in accordance with such embodiment(s) of the present invention, it is preferred that each of a plurality of charging units be respectively provided with a separate high-voltage power supply; switching at a low-voltage primary side of any one of the high-voltage power supplies causing a high-voltage output to the corresponding charging unit to be controlled in ON/OFF fashion. Such a constitution will facilitate high-voltage switching. That is, where high-voltage output is switched by switching means, ability to withstand high voltages will be required of the switching means, making ON/OFF control difficult; but by carrying out ON/OFF control of high-voltage output at the low-voltage primary side of the high-voltage power supply, such ON/OFF control will be facilitated.

While it is preferred that the charging units used in an image forming apparatus in accordance with such embodiment(s) of the present invention be corona-type charging units, contact-type charging units utilizing roller charging and/or brush charging may be used.

An electrophotographic image forming apparatus in accordance with one or more embodiments of the present invention is capable of carrying out one or more image forming processes setting at a plurality of processing speeds; permits selective switching between or among the processing speeds; comprises at least one first charging unit (e.g., a charging unit having a case width of 14 mm) versatile enough to be used in at least one other model of image forming apparatus; and comprises at least one second charging unit (e.g., a charging unit having a case width of 24 mm) having at least one configuration different from at least one configuration of at least one of the first charging unit or units; driving of at least one of the first charging unit or units and/or at least one of the second charging unit or units being switched in correspondence to at least one processing speed.

In the case of, for example, a tandem-type full-color apparatus, an image forming apparatus in accordance with such embodiment(s) of the present invention might be such that a first charging unit and a second charging unit are employed for black, only the first charging unit which has a case width of 14 mm being driven during color printing (e.g., processing speed=220 mm/sec (30 pages/min)), and only the second charging unit which has a case width of 24 mm being driven during monochromatic printing (e.g., processing speed=330 mm/sec (45 pages/min)); such that because it is possible at each processing speed to employ a charging unit having a case width that is suited thereto, it is possible to reduce the amount of ozone produced as compared with the situation in which charging units having identical configurations are driven in parallel (two charging units having case widths of 14 mm driven in parallel). Furthermore, because one black charging unit is used during monochromatic printing and the other black charging unit is used during color printing, the black charging unit used for color printing will have the same charging history as the charging units used for the other colors (cyan, magenta, and yellow), and so image quality will be made more stable.

In an image forming apparatus in accordance with such embodiment(s) of the present invention, it is preferred that at least one of the second charging unit or units be versatile enough to be used in at least one other model of image forming apparatus.

In such embodiment(s) of the present invention, operations for switching driving of a first charging unit (case width Wc=14 mm) and a second charging unit (case width Wc=24 mm) might, for example as shown in FIG. 10, be carried out such that the first charging unit (case width Wc=14 mm) is driven when processing speed is less than or equal to 275 mm/sec, and the second charging unit (case width Wc=24 mm) is driven when processing speed is greater than 275 mm/sec. Furthermore, as shown in FIG. 10, discharge current (total current) is also switched between value(s) used when processing speed is less than or equal to 275 mm/sec and value(s) used when processing speed is greater than 275 mm/sec.

While it is preferred that the charging units used in an image forming apparatus in accordance with such embodiment(s) of the present invention be corona-type charging units, contact-type charging units utilizing roller charging and/or brush charging may be used.

DESCRIPTION OF PREFERRED EMBODIMENTS

Below, embodiments of the present invention are described with reference to the drawings.

Embodiment 1

Figure 1:
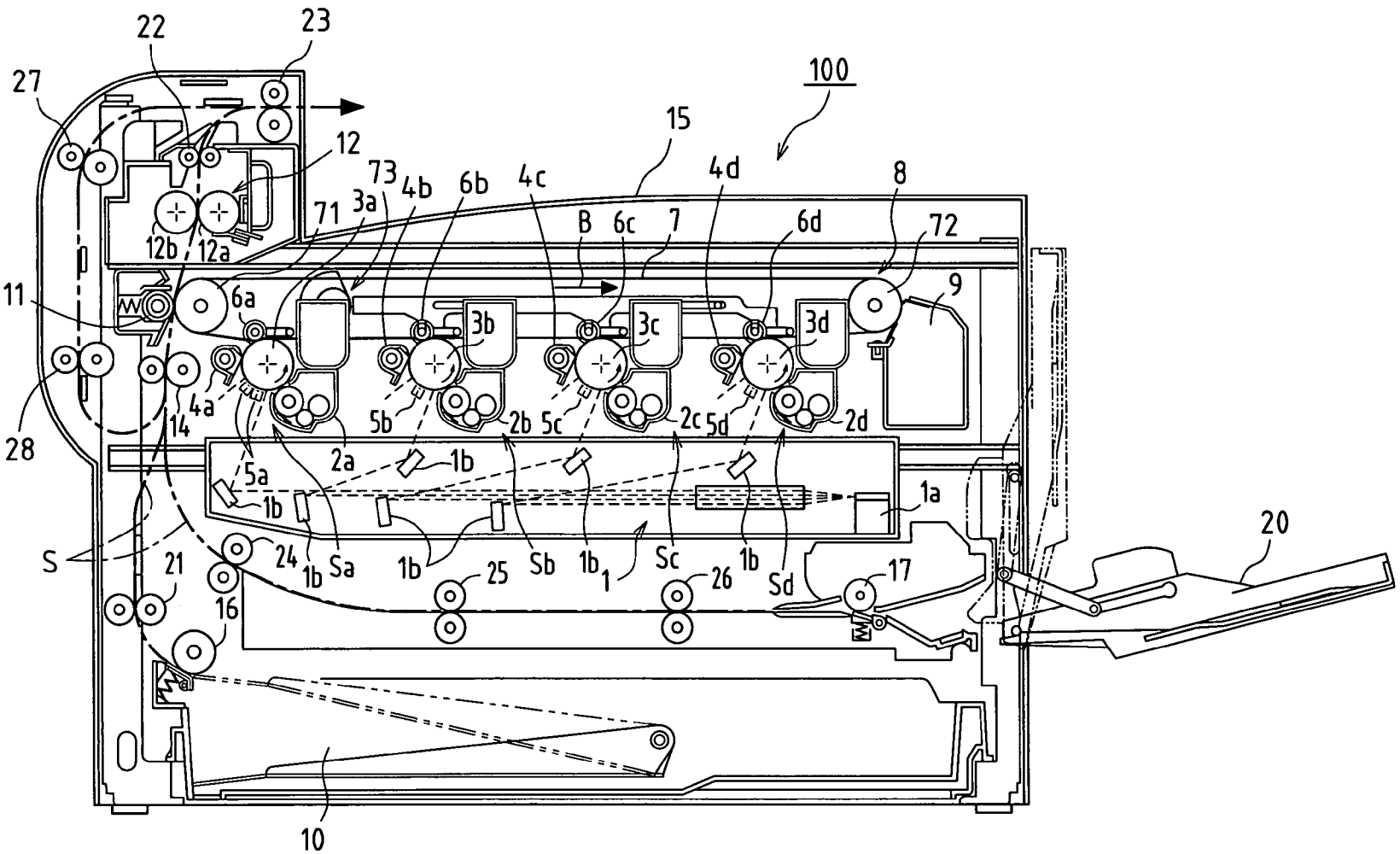
FIG. 1 is a drawing showing in schematic fashion the structure of an example of an image forming apparatus in accordance with the present invention.

FIG. 1 is a drawing showing in schematic fashion an example of an image forming apparatus in accordance with the present invention.

Image forming apparatus 100 shown in FIG. 1, which is a tandem-type color image forming apparatus forming multicolor and/or monochromatic images on recording paper (sheet media) in correspondence to image data transmitted thereto from the exterior, comprises exposing unit 1; developer units 2*a* through 2*d*; photosensitive drums 3*a* through 3*d*; charging units 5*a* through 5*d*; cleaning units 4*a* through 4*d*; intermediate transfer belt 7; intermediate transfer belt unit 8; fuser unit 12; paper transport path S; media supply tray 10; discharge tray 15; and so forth.

Image data handled by image forming apparatus 100 corresponds to color images utilizing the respective colors black (K), cyan (C), magenta (M), and yellow (Y). Accordingly, as shown in FIG. 1, there are four each of developer units 2*a*, 2*b*, 2*c*, 2*d*, photosensitive drums 3*a*, 3*b*, 3*c*, 3*d*, charging units 5*a*, 5*b*, 5*c*, 5*d*, and cleaning units 4*a*, 4*b*, 4*c*, 4*d* provided so as to respectively form four latent images in correspondence to the respective colors (K, C, M, Y) and constituting four image forming stations Sa, Sb, Sc, Sd corresponding to the respective colors (K, C, M, Y). Note, at the respective reference numerals, that the letter "a" corresponds to black, the letter "b" corresponds to cyan, the letter "c" corresponds to magenta, and the letter "d" corresponds to yellow.

Photosensitive drums 3*a* through 3*d* are arranged at the upper portion of image forming apparatus 100.

Figure 2:
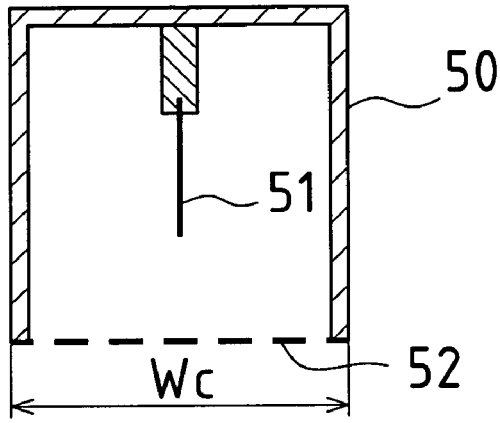
FIG. 2 is a sectional view showing in schematic fashion the constitution of a charging apparatus employed by an image forming apparatus in accordance with the present invention.
Figure 3:
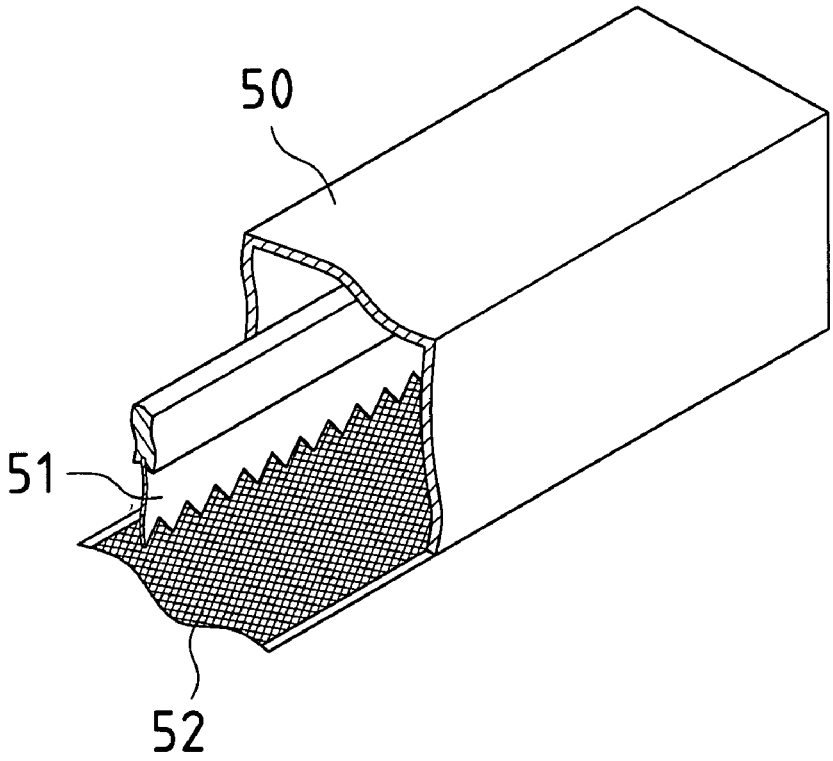
FIG. 3 is an oblique view of the charging unit of FIG. 2.

Charging units 5*a* through 5*d* are charging means for causing the surfaces of photosensitive drums 3*a* through 3*d* to be uniformly charged to prescribed electric potential(s); as shown in FIGS. 2 and 3, scorotron-type charging units are used, each of which has sawtooth-shaped discharge electrode 51, mesh-like grid 52, and case 50 covering discharge electrode 51. In addition, in the present example, two charging units 5*a* having identical configuration are arranged at black (K) image forming station Sa, and there is one charging unit 5*b*, 5*c*, 5*d* arranged at each image forming station Sb, Sc, Sd corresponding to the other respective colors cyan (C), magenta (M), and yellow (Y).

Here, the two charging units 5*a*, 5*a* employed for black (K), and the charging units 5*b*, 5*c*, 5*d* employed for respective colors cyan (C), magenta (M), and yellow (Y), have identical configurations, case width thereof being 14 mm. Moreover, charging units 5*a*, 5*b*, 5*c*, 5*d* are versatile enough to also be capable of being used in other image forming apparatus model(s) having different processing speed(s).

Figure 4:
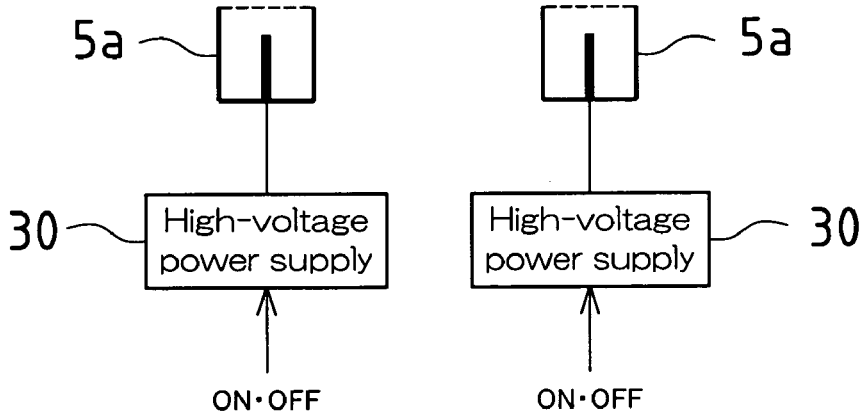
FIG. 4 is a drawing to assist in describing ON/OFF control of a high-voltage power supply during supply of high-voltage electric power to a charging unit.

Furthermore, as shown in FIG. 4, the two charging units 5*a*, 5*a* arranged at black image forming station Sa are respectively supplied with high-voltage electric power from separate high-voltage power supplies 30, 30. The high-voltage outputs from these high-voltage power supplies 30, 30 to charging units 5*a*, 5*a* are turned ON/OFF as a result of control accomplished by switching of the low-voltage primary sides of high-voltage power supplies 30, 30.

Besides scorotron-type charging units and other such corona-type charging units, note that contact-type charging units utilizing roller charging and/or brush charging may be used as charging unit(s).

By exposing charged photosensitive drums 3*a* through 3*d* in correspondence to image data input thereto, exposing unit 1 has the ability to cause formation of latent electrostatic images on the surfaces of those respective photosensitive drums 3*a* through 3*d* in correspondence to image data. Exposing unit 1 employs a laser scanning unit (LSU) equipped with laser-emitting component 1*a*, reflecting mirrors 1*b*, and so forth. Moreover, as exposing unit 1, device(s) may be employed such as, for example, EL and/or LED write head(s) in which light-emitting elements are arranged in array-like fashion.

Developer units 2*a* through 2*d* use toner of respective colors (K, C, M, Y) to cause the latent electrostatic images formed on photosensitive drums 3*a* through 3*d* to become manifest. Cleaning units 4*a* through 4*d* remove/recover toner remaining on the surfaces of photosensitive drums 3*a* through 3*d* following develop/image transfer.

Intermediate transfer belt unit 8 is arranged above photosensitive drums 3*a* through 3*d*. Intermediate transfer belt unit 8 is equipped with intermediate transfer belt 7, intermediate transfer belt drive roller 71, intermediate transfer belt tension mechanism 73, intermediate transfer belt idler roller 72, intermediate transfer rollers 6*a*, 6*b*, 6*c*, 6*d*, and intermediate transfer belt cleaning unit 9. This intermediate transfer belt drive roller 71, intermediate transfer belt tension mechanism 73, intermediate transfer rollers 6*a* through 6*d*, intermediate transfer belt idler roller 72, and so forth suspend and impart tension to intermediate transfer belt 7 and cause intermediate transfer belt 7 to be driven in rotational fashion in the direction indicated by arrow B.

Intermediate transfer rollers 6*a* through 6*d* are rotatably supported by intermediate transfer roller attachment site(s) (not shown) at intermediate transfer belt tension mechanism 73 of intermediate transfer belt unit 8, and deliver transfer bias(es) for transfer of toner images from photosensitive drums 3*a* through 3*d* to intermediate transfer belt 7.

Intermediate transfer belt 7 is disposed so as to respectively come in contact with photosensitive drums 3*a* through 3*d*, and sequentially transfers toner images of respective colors which are formed on respective photosensitive drums 3*a* through 3*d* to intermediate transfer belt 7 in superposed fashion to form color toner image(s) (multicolor toner image(s)) on intermediate transfer belt 7. Intermediate transfer belt 7 is formed in endless fashion using film of thickness on the order of 100μ to 150μ. Moreover, during monochromatic printing, described below, only black (K) photosensitive drum 3*a* comes in contact with intermediate transfer belt 7.

Transfer of toner images from photosensitive drums 3*a* through 3*d* to intermediate transfer belt 7 is carried out as a result of action of intermediate transfer rollers 6*a* through 6*d*, which come in contact with the back of intermediate transfer belt 7. To cause transfer of the toner images, high-voltage transfer bias(es) (high voltage(s) of opposite polarity (+) as charge polarity (−) of toner) are applied to intermediate transfer rollers 6*a* through 6*d*.

Each of intermediate transfer rollers 6*a* through 6*d* is such that electrically conductive elastic material (e.g., EPDM, urethane foam, etc.) covers the surface of base material in the form of a metal (e.g., stainless steel) shaft of diameter 8 mm to 10 mm. This electrically conductive elastic material is capable of uniformly applying a high voltage to intermediate transfer belt 7. Note that while intermediate transfer rollers 6*a* through 6*d* are employed as transfer electrodes in the present example, brushes may alternatively or additionally be employed.

Thus, latent electrostatic images made manifest in correspondence to respective color hues on respective photosensitive drums 3*a* through 3*d* are stacked one atop the other on intermediate transfer belt 7 to become the image information that was input to the apparatus. Rotation of intermediate transfer belt 7 causes image information thus stacked one atop the other to be transferred onto recording paper by transfer roller 11, which is arranged at the location at which intermediate transfer belt 7 comes in contact with the recording paper, described below.

At this time, intermediate transfer belt 7 and transfer roller 11 are compressed by a prescribed nip, and voltage(s) for transferring toner to recording paper is/are applied to transfer roller 11 (high voltage(s) of opposite polarity (+) as charge polarity (−) of toner). Moreover, so that the foregoing nip is attained in constant fashion, it is preferred that either transfer roller 11 or the aforementioned intermediate transfer belt drive roller 71 be made from hard material (metal or the like), and the other comprise elastic roller or other such soft material (e.g., elastic rubber roller, foamed resin roller, etc.).

Furthermore, because, as described above, contact with photosensitive drums 3*a* through 3*d* can cause toner adhering to intermediate transfer belt 7, and/or toner not transferred to recording paper by transfer roller 11 and remaining on intermediate transfer belt 7, to produce occurrence of color mixing during subsequent operation(s), intermediate transfer belt cleaning unit 9 is constructed so as to remove/recover same.

Intermediate transfer belt cleaning unit 9 is equipped with a member, e.g., a cleaning blade serving as cleaning member, which comes in contact with intermediate transfer belt 7; intermediate transfer belt 7 being supported from the back thereof by intermediate transfer belt idler roller 72 at the approximate location at which this cleaning blade comes in contact with intermediate transfer belt 7.

Media supply tray 10, being a tray for storage of recording paper (recording sheet media) used for image formation, is provided below exposing unit 1 of image forming apparatus 100. Furthermore, discharge tray 15 provided at the upper portion of image forming apparatus 100 is a tray for accepting face-down placement of recording paper on which printing has been completed.

Furthermore, image forming apparatus 100 is provided with more or less perpendicularly configured paper transport path S for delivering recording paper from media supply tray 10 to discharge tray 15 by way of transfer roller 11 and fuser unit 12. Moreover, arranged in the vicinity of paper transport path S which extends from media supply tray 10 to discharge tray 15 are takeup roller 16, registration rollers 14, transfer roller 11, fuser unit 12, and transport rollers 21 through 28 for transporting the recording paper.

Transport rollers 21 through 26 are small rollers employed to promote/assist transport of recording paper, a plurality thereof being provided along paper transport path S.

Takeup roller 16 is provided at one end of media supply tray 10. Takeup roller 16 is a roller for supplying recording paper one sheet at a time to paper transport path S from media supply tray 10. Registration rollers 14 temporarily retain recording paper being transported along paper transport path S, and transport the recording paper to transfer roller 11 with such timing as to cause the lead edge of the recording paper to be aligned with the lead edges of the toner images on intermediate transfer belt 7.

Fuser unit 12 is equipped with hot roller 12*a*, pressure roller 12*b*, and so forth. This hot roller 31 and this pressure roller 32 rotate as the recording paper is held in the nip formed therebetween.

Furthermore, hot roller 12*a* is set so as to be at prescribed fusing temperature(s) as a result of control based on signal (s) from temperature detector(s), not shown; and, together with pressure roller 12*b*, subjects the recording paper to thermocompression to cause the multicolor toner image transferred to the recording paper to be melted, fused, and compressed, thermocompressively bonding same to the recording paper.

Moreover, following fusing of the multicolor toner image thereonto, the recording paper is transported by transport rollers 22 and discharge rollers 23 along the flipping discharge route of paper transport path S so as to cause the recording paper to be discharged into discharge tray 15 in a flipped state (i.e., such that the multicolor toner image faces down).

Next, the paper transport path will be described in detail.

First, arranged at image forming apparatus 100 of the present example is automatic-feed cassette 10, storing recording paper in advance; and manual-feed tray 20, obviating the need to carry out open/close operations at automatic-feed cassette 10 when the user is printing a small number of pages. Supply of paper from this automatic-feed cassette 10 and this manual-feed tray 20 is carried out in accordance with a method in which recording paper is delivered one sheet at a time to the transport path by takeup rollers 16, 17 respectively arranged at one end of respective trays 10, 20.

Recording paper transported from automatic-feed cassette 10 is transported to registration rollers 14 by transport rollers 21 within the transport path, from which it is transported to transfer roller 11 with such timing as to cause the lead edge of the recording paper to be brought into registration with the lead edges of the image information on intermediate transfer belt 7 to cause image information to be written onto the recording paper. The recording paper thereafter passes through fuser unit 12, where the unfused toner on the recording paper is melted by heating and is fused thereto, and travels via transport rollers 22 to where it is discharged therefrom by discharge rollers 23 to discharge tray 15 (at the time of a single-sided print request).

On the other hand, recording paper stacked at manual-feed tray 20 is fed therefrom by takeup roller 17 and travels via a plurality of transport rollers 26, 25, 24 to arrive at registration rollers 14, following which it undergoes the same course of events as when recording paper is supplied from automatic-feed cassette 10, and is discharged onto discharge tray 15 (at the time of a single-sided print request).

Here, when the content of the print request is such as to require double-sided printing, single-sided printing is carried out as described above, following which the trail edge of the recording paper, having passed through fuser unit 12, is held by discharge rollers 23, and discharge rollers 23 are made to rotate in reverse fashion so that the recording paper is guided to transport rollers 27, 28. In addition, after traveling by way of registration rollers 14 and printing has been carried out on the back side thereof, the recording paper is thereafter discharged onto discharge tray 15.

When color printing is to be carried out at the foregoing image forming apparatus 100, photosensitive drums 3*a*, 3*b*, 3*c*, 3*d* corresponding to respective colors black (K), cyan (C), magenta (M), and yellow (Y) are all made to come in contact with intermediate transfer belt 7, driving thereof being such that processing speed is 220 mm/sec (30 pages/min). When carrying out printing at this processing speed of 220 mm/sec, one of the two charging units (case width=14 mm) 5*a*, 5*a* arranged at black (K) image forming station Sa is driven.

On the other hand, when monochromatic printing of only black (K) is to be carried out, photosensitive drums 3*b*, 3*c*, 3*d* corresponding to respective colors cyan (C), magenta (M), and yellow (Y) are all made to back away from intermediate transfer belt 7, only black (K) photosensitive drum 3*a* being made to come in contact with intermediate transfer belt 7; and processing speed is switched to 330 mm/sec (45 pages/min), i.e., is increased by a factor of 1.5, to permit achievement of high-speed monochromatic printing. When thus carrying out monochromatic printing at a processing speed of 330 mm/sec, the two charging units (case width=14 mm) 5*a*, 5*a* arranged at black (K) image forming station Sa are driven in parallel.

At image forming apparatus 100 of the present example, because charging units 5*a*, 5*b*, 5*c*, 5*d* arranged at the four image forming stations Sa, Sb, Sc, Sd corresponding to the respective colors (K, C, M, Y) are of identical model (identical configuration), and because those charging units 5*a*, 5*b*, 5*c*, 5*d* are versatile enough to also be capable of being used in other image forming apparatus model(s) having different processing speed(s), it is possible to achieve such benefits as reduction in cost, reduction in inventory, and faster turnaround.

Embodiment 2

Figure 5:
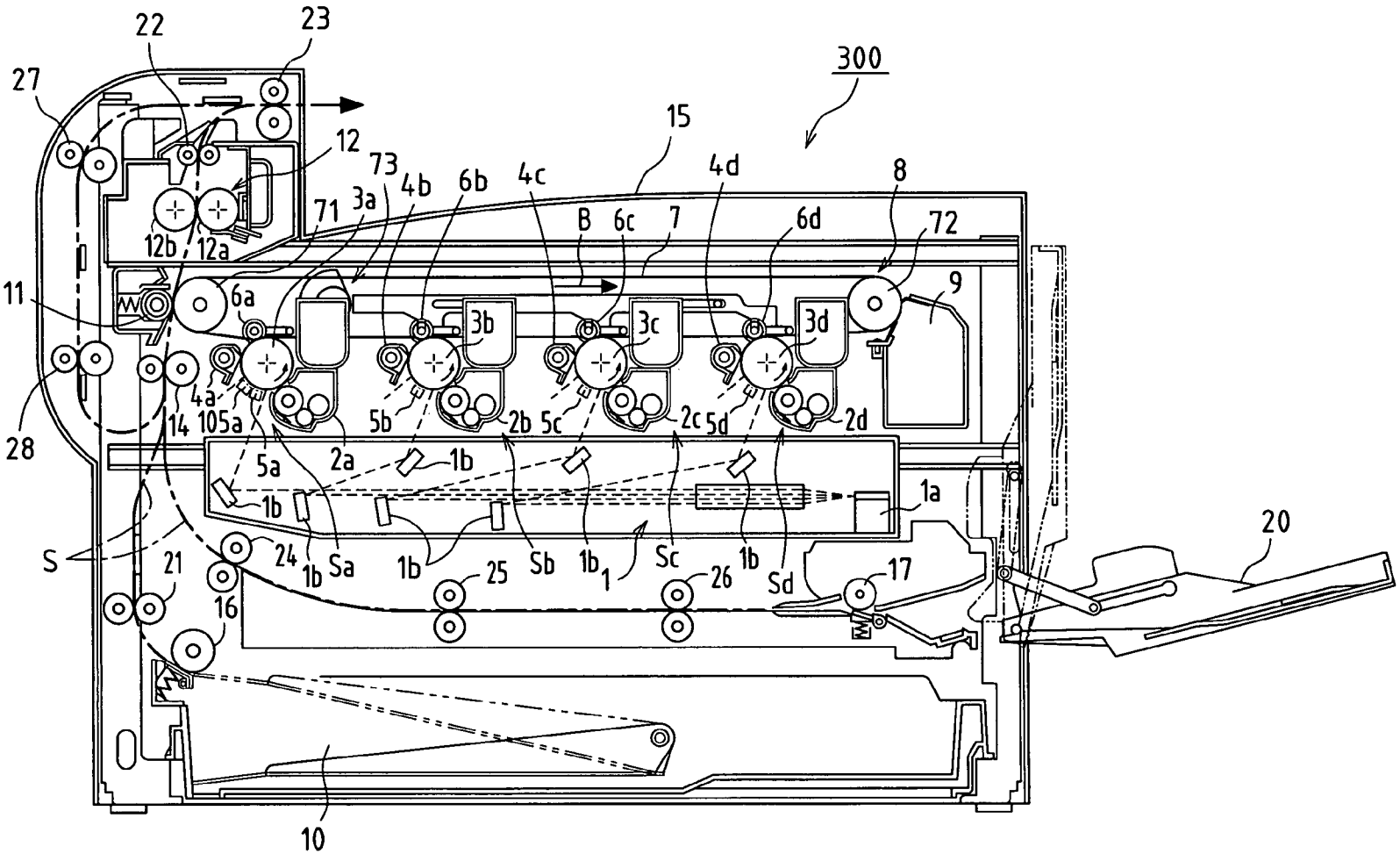
FIG. 5 is a drawing showing in schematic fashion the structure of another example of an image forming apparatus in accordance with the present invention.

FIG. 5 is a drawing showing in schematic fashion the constitution of another example of an image forming apparatus in accordance with the present invention.

Image forming apparatus 300 shown in FIG. 5, which is of basically the same constitution as the foregoing image forming apparatus 100 of FIG. 1, is equipped with exposing unit 1; developer units 2*a* through 2*d*; photosensitive drums 3*a* through 3*d*; cleaning units 4*a* through 4*d*; charging units 5*a*, 105*a*, 5*b*, 5*c*, 5*d*; intermediate transfer belt 7; intermediate transfer belt unit 8; transfer roller 11; fuser unit 12; paper transport path S; media supply tray 10; discharge tray 15; and so forth. Note that since, except for those aspects described below that are different (charging units), constitution is in other respects identical to that of the image forming apparatus of FIG. 1, detailed description thereof will be omitted.

—Charging Units—

Charging units 5*a*, 105*a*, 5*b*, 5*c*, 5*d* are charging means for causing the surfaces of photosensitive drums 3*a*, 3*b*, 3*c*, 3*d* to be uniformly charged to prescribed electric potential (s); as shown in FIGS. 2 and 3, scorotron-type charging units are used, each of which has sawtooth-shaped discharge electrode 51, mesh-like grid 52, and case 50 covering discharge electrode 51.

In addition, in the present example, first charging unit 5*a* and second charging unit 105*a* are arranged at black (K) image forming station Sa, and there is one charging unit 5*b*, 5*c*, 5*d* arranged at each image forming station Sb, Sc, Sd corresponding to the other respective colors cyan (C), magenta (M), and yellow (Y).

First charging unit 5*a* arranged at black (K) image forming station Sa, and charging units 5*b*, 5*c*, 5*d* arranged at image forming stations Sb, Sc, Sd corresponding to respective colors cyan (C), magenta (M), and yellow (Y), have identical configurations, case width thereof being 14 mm. This first charging unit 5*a* and these charging units 5*b*, 5*c*, 5*d* are versatile enough to also be capable of being used in other image forming apparatus model(s) having different processing speed(s).

Furthermore, second charging unit 105*a* arranged at black (K) image forming station Sa has a case width of 24 mm. This second charging unit 105*a* is also versatile enough to be used in other image forming apparatus model(s).

In addition, first charging unit 5*a* and second charging unit 105*a* arranged at black (K) image forming station Sa are respectively supplied with high-voltage electric power from separate high-voltage power supplies 30, 30 (see FIG. 4). The high-voltage outputs from these high-voltage power supplies 30, 30 to first charging unit 5*a* and second charging unit 105*a* are turned ON/OFF as a result of control accomplished by switching of the low-voltage primary sides of high-voltage power supplies 30, 30.

Besides scorotron-type charging units and other such corona-type charging units, note that contact-type charging units utilizing roller charging and/or brush charging may be used as charging unit(s).

When color printing is to be carried out at image forming apparatus 300 of the present example, photosensitive drums 3*a*, 3*b*, 3*c*, 3*d* corresponding to respective colors black (K), cyan (C), magenta (M), and yellow (Y) are all made to come in contact with intermediate transfer belt 7, driving thereof being such that processing speed is 220 mm/sec (30 pages/min). When carrying out printing at this processing speed of 220 mm/sec, as far as black (K) is concerned, only first charging unit (case width=14 mm) 5*a* arranged at image forming station Sa is driven.

On the other hand, when monochromatic printing of only black (K) is to be carried out, photosensitive drums 3*b*, 3*c*, 3*d* corresponding to respective colors cyan (C), magenta (M), and yellow (Y) are all made to back away from intermediate transfer belt 7, only black (K) photosensitive drum 3*a* being made to come in contact with intermediate transfer belt 7; and processing speed is switched to 330 mm/sec (45 pages/min), i.e., is increased by a factor of 1.5, to permit achievement of high-speed monochromatic printing. When thus carrying out monochromatic printing at a processing speed of 330 mm/sec, only second charging unit (case width=24 mm) 105*a* arranged at black (K) image forming station Sa is driven.

At image forming apparatus 300 of the present example, because first charging unit 5*a* having a case width of 14 mm is driven during color printing (e.g., processing speed=220 mm/sec (30 pages/min)), and because second charging unit 105*a* having a case width of 24 mm is driven during monochromatic printing (e.g., processing speed=330 mm/sec (45 pages/min)), it is possible at each processing speed to employ a charging unit having a case width that is suited thereto. Accordingly, it is possible to reduce the amount of ozone produced as compared with that produced by the constitution of the foregoing first embodiment, i.e., the situation in which charging units 5*a* having identical configuration are driven in parallel (two charging units having case widths of 14 mm are driven in parallel). Furthermore, because one black charging unit (second charging unit 105*a*) is used during monochromatic printing and the other black charging unit (first charging unit 5*a*) is used during color printing, black first charging unit 5*a* used for color printing will have the same charging history as charging units 5*b*, 5*c*, 5*d* used for the other colors (cyan, magenta, and yellow), and so image quality will be made more stable.

Embodiment 3

Figure 6:
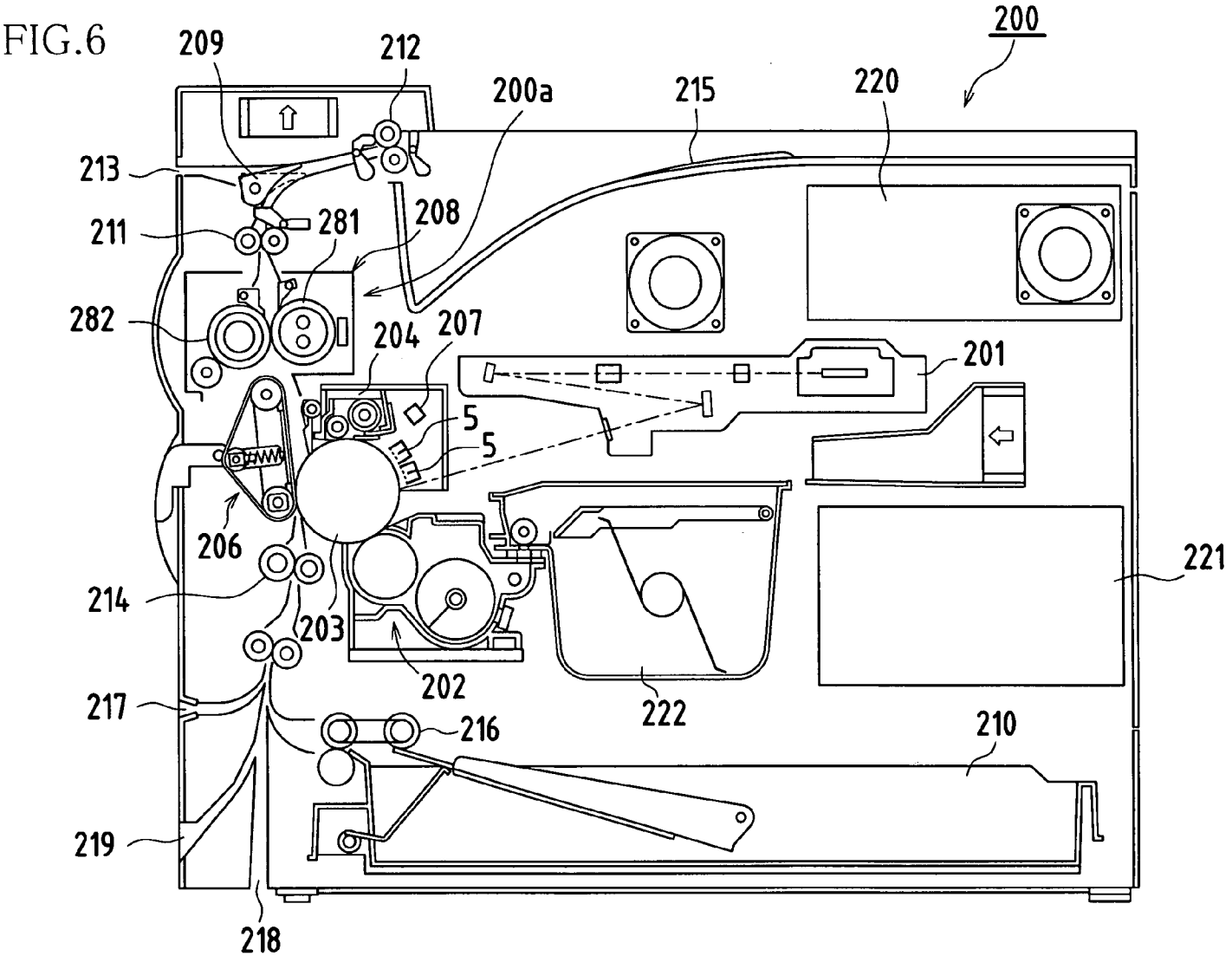
FIG. 6 is a drawing showing in schematic fashion the structure of a different example of an image forming apparatus in accordance with the present invention.

FIG. 6 is a drawing showing in schematic fashion the constitution of a different example of an image forming apparatus in accordance with the present invention.

Image forming apparatus 200 shown in FIG. 6 is a monochromatic image forming apparatus employing electrophotography to record, on recording paper (sheet media), monochromatic images supplied thereto from external equipment (e.g., scanner, personal computer, or other such image output apparatus).

Photosensitive drum 203 is rotatably supported at image forming unit 200*a* of image forming apparatus 200; arranged about photosensitive drum 203 there are, in order in the direction of rotation of photosensitive drum 203: two charging units 5, 5; optical scanning unit 201; developer unit 202; transfer apparatus 206; cleaning unit 204; charge-removing lamp 207; and so forth.

The two charging units 5, 5 are charging means for causing the surface of photosensitive drum 203 to be uniformly charged to prescribed electric potential(s); as shown in FIGS. 2 and 3, scorotron-type charging units are used, each of which has sawtooth-shaped discharge electrode 51, mesh-like grid 52, and case 50 covering discharge electrode 51. Here, the two charging units 5, 5 have identical configurations, case width thereof being 14 mm. Furthermore, these charging units 5, 5 are versatile enough to also be capable of being used in other image forming apparatus model(s) having different processing speed(s).

Moreover, the two charging units 5, 5 arranged at image forming unit 200*a* are respectively supplied with high-voltage electric power from separate high-voltage power supplies 30, 30 (see FIG. 4). The high-voltage outputs from these high-voltage power supplies 30, 30 to respective charging units 5, 5 are turned ON/OFF as a result of control accomplished by switching of the low-voltage primary sides of respective high-voltage power supplies 30, 30.

Optical scanning unit 201 causes an optical image to be scanned across the uniformly charged surface of photosensitive drum 203 to write a latent electrostatic image. Developer unit 202 uses toner supplied from developer supply container 222 to cause the latent electrostatic image written by optical scanning unit 201 to become manifest as a toner image.

Transfer apparatus 206 transfers the toner image formed on the surface of photosensitive drum 203 onto recording paper. Cleaning unit 204 removes toner residue from the surface of photosensitive drum 203, making it possible for new image(s) to be recorded on photosensitive drum 203. Charge-removing lamp 207 removes residual charge from the surface of photosensitive drum 203.

Supply tray 210 is arranged within image forming apparatus 200, being removably installed at the lower portion thereof. Supply tray 210 houses recording paper. Recording paper housed in supply tray 210 is separated one sheet at a time by takeup roller 216 and so forth, and is transported to registration rollers 214.

Registration rollers 214 guide the recording paper such that it travels between transfer apparatus 206 and photosensitive drum 203 in synchronous fashion with respect to the image formed on the surface of photosensitive drum 203. The toner image formed on the surface of photosensitive drum 203 is transferred onto the recording paper by transfer apparatus 206. Replenishment of recording paper at supply tray 210 is carried out by pulling supply tray 210 outward, toward the front side (the side at which the operation panel located) of image forming apparatus 200.

Moreover, at sheet inlet 218, there is an opening in the base of image forming apparatus 200. Sheet inlet 218 accepts into image forming apparatus 200 recording paper transported thereto from a supply tray provided at a desk device (not shown) serving as peripheral equipment on which image forming apparatus 200 is placed. Furthermore, recording paper other than recording paper housed at supply tray 210 is accepted into image forming apparatus 200 from additional receiving site 219.

Fuser apparatus 208 is arranged within image forming apparatus 200, at the upper portion thereof. Fuser apparatus 208 causes the recording paper, onto which the toner image has been transferred, to pass between hot roller 281 and pressure roller 282, fusing the toner image onto the recording paper. As a result, image(s) is/are recorded on recording paper.

Recording paper, on which image(s) have been formed, is transported upward by transport rollers 211 and passes through switching gate 209. In the event that the location from which the recording paper is to be discharged is chosen to be stacked tray 215 provided at the exterior of image forming apparatus 200, the recording paper is discharged onto stacked tray 215 by flipping rollers 212.

On the other hand, in the event that double-sided image formation processing and/or postprocessing has been designated, the recording paper is first discharged by flipping rollers 212 as if directed toward stacked tray 215, but flipping rollers 212 then stop with the trail edge of the recording paper held therebetween and are thereafter driven in reverse. This makes it possible for the recording paper to be transported via discharge path 213 to recording media resupply transport apparatus(es) (not shown) and/or to postprocessing apparatus(es) (not shown) selectively installed at the side of image forming apparatus 200 for double-sided image formation processing and/or postprocessing. At such time, switching gate 209 is switched from the state indicated by the solid line to the state indicated by the broken line in FIG. 6.

In the event that double-sided image formation processing is to be carried out, after being flipped and transported, the recording paper passes through the recording media resupply transport apparatus, and is again supplied to the interior of image forming apparatus 200 via retransport path 217. In the event that postprocessing is to be carried out, the recording paper is transported from the recording media resupply transport apparatus to the postprocessing apparatus by way of a relay transport apparatus, not shown, pursuant to action of a different switching gate.

Arranged in the spaces above and below optical scanning unit 201 are controller 220, which houses circuit board(s) controlling image forming processes, interface board(s)

accepting image data from external equipment, and so forth; power supply apparatus 211, which supplies electric power to the aforementioned interface board(s) and the various components carrying out the aforementioned image formation; and so forth.

A plurality of processing speeds (e.g., 100 mm/sec, 200 mm/sec, 300 mm/sec, 400 mm/sec, etc.) are established at the foregoing image forming apparatus 200; when a processing speed that is less than or equal to 275 mm/sec is selected from among these processing speeds to carry out printing, one of the two charging units (case width=14 mm) 5, 5 arranged at image forming unit 200*a* is driven. On the other hand, when carrying out printing at a processing speed that is greater than 275 mm/sec, the two charging units (case width=14 mm) 5, 5 arranged at image forming unit 200*a* are driven in parallel.

At image forming unit 200*a* of the present example, because charging units 5, 5 arranged at image forming unit 200*a* are of identical model (identical configuration), and because these charging units 5, 5 are versatile enough to also be capable of being used in other image forming apparatus model(s) having different processing speed(s), it is possible to achieve such benefits as reduction in cost, reduction in inventory, and faster turnaround.

Embodiment 4

Figure 7:
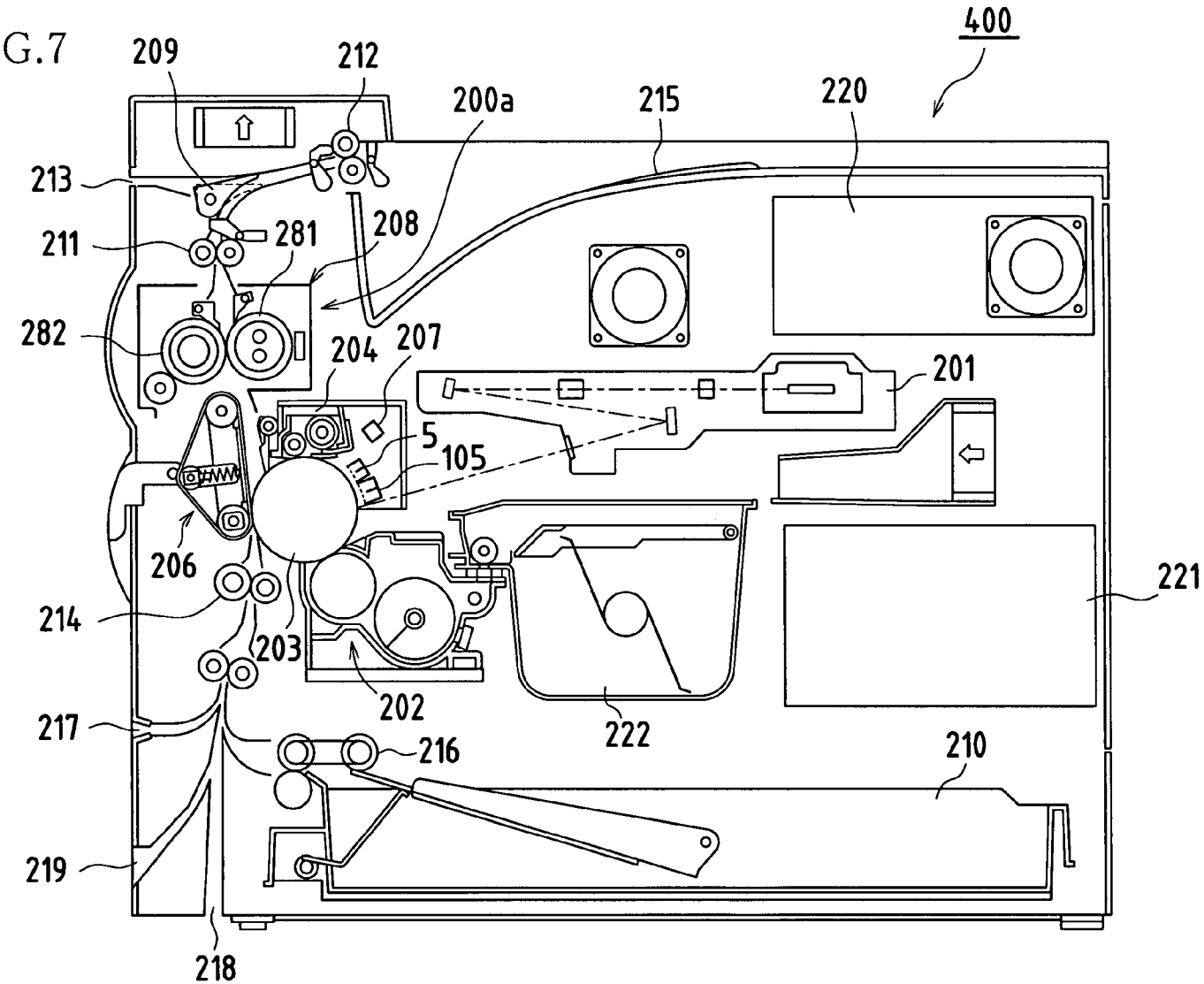
FIG. 7 is a drawing showing in schematic fashion the structure of a different example of an image forming apparatus in accordance with the present invention.
Figure 8:
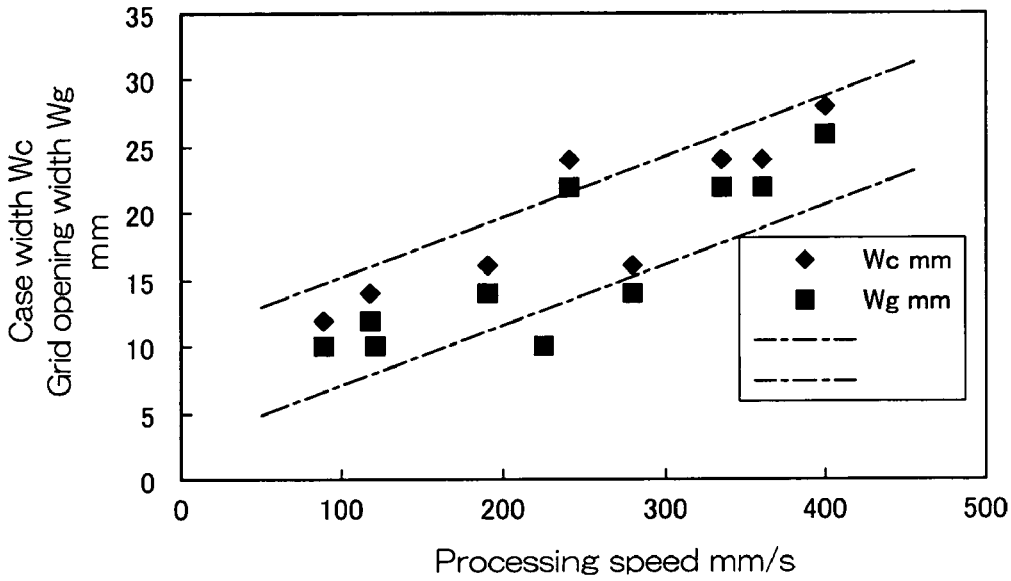
FIG. 8 is a graph showing relationship between processing speed and charging unit case width.
Figure 9:
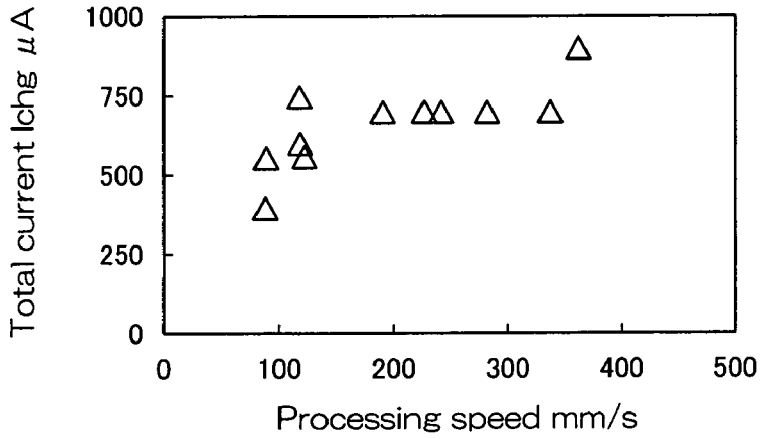
FIG. 9 is a graph showing relationship between processing speed and total current at charging unit.

FIG. 7 is a drawing showing in schematic fashion the constitution of a different example of an image forming apparatus in accordance with the present invention.

Image forming apparatus 400 shown in FIG. 7, which is of basically the same constitution as the foregoing image forming apparatus 200 of FIG. 6, is equipped with such components as image forming unit 200*a* having photosensitive drum 203; two charging units 5, 105; optical scanning unit 201; developer unit 202; transfer apparatus 206; cleaning unit 204; charge-removing lamp 207; and so forth. Note that since, except for those aspects described below that are different (charging units), constitution is in other respects identical to that of the image forming apparatus of FIG. 6, detailed description thereof will be omitted.

—Charging Units—

In this example, first charging unit 5 and second charging unit 105 are arranged at image forming unit 200*a*. First charging unit 5 and second charging unit 105 are charging means for causing the surface of photosensitive drum 203 to be uniformly charged to prescribed electric potential(s); as shown in FIGS. 2 and 3, scorotron-type charging units are used, each of which has sawtooth-shaped discharge electrode 51, mesh-like grid 52, and case 50 covering discharge electrode 51.

First charging unit 5 arranged at image forming unit 200*a* has a case width of 14 mm. This first charging unit 5 is versatile enough to be used in other image forming apparatus model(s). Furthermore, second charging unit 105 has a case width of 24 mm. This second charging unit 105 is also versatile enough to be used in other image forming apparatus model(s).

Moreover, first charging unit 5 and second charging unit 105 arranged at image forming unit 200*a* are respectively supplied with high-voltage electric power from separate high-voltage power supplies 30, 30 (see FIG. 4). The high-voltage outputs from these high-voltage power supplies 30, 30 to first charging unit 5 and second charging unit 105 are turned ON/OFF as a result of control accomplished by switching of the low-voltage primary sides of respective high-voltage power supplies 30, 30.

Besides scorotron-type charging units and other such corona-type charging units, note that contact-type charging units utilizing roller charging and/or brush charging may be used as charging unit(s).

Figure 10:
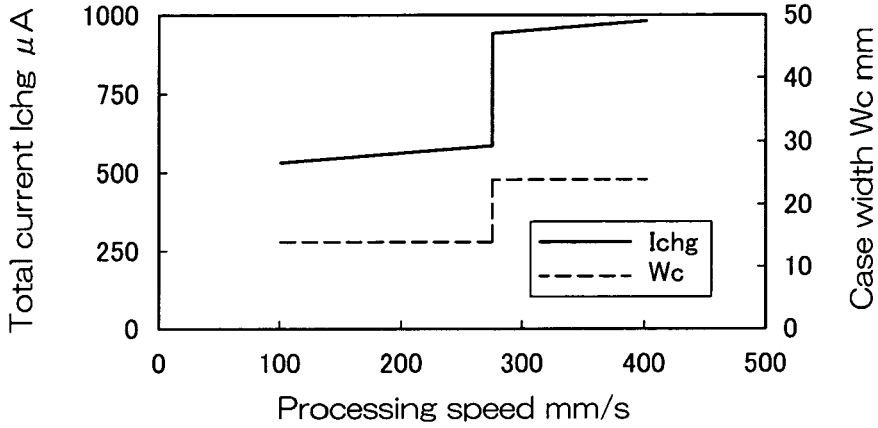
FIG. 10 is a graph showing relationship among processing speed and case width and total current at charging unit.

A plurality of processing speeds (e.g., 100 mm/sec, 200 mm/sec, 300 mm/sec, 400 mm/sec, etc.) are established at the foregoing image forming apparatus 400; when a processing speed that is less than or equal to 275 mm/sec is selected from among these processing speeds to carry out printing, only first charging unit (case width=14 mm) 5 arranged at image forming unit 200*a* is driven (see FIG. 10). On the other hand, when carrying out printing at a processing speed that is greater than 275 mm/sec, only second charging unit (case width=24 mm) 105 arranged at image forming unit 200*a* is driven (see FIG. 10). Furthermore, as shown in FIG. 10, respective discharge currents (total current) at charging units 5, 105 is also switched between value(s) used when processing speed is less than or equal to 275 mm/sec and value(s) used when processing speed is greater than 275 mm/sec.

At image forming apparatus 400 of the present example, because only first charging unit 5 having a case width of 14 mm is driven when processing speed is less than or equal to 275 mm/sec, and because only second charging unit 105 having a case width of 24 mm is driven when processing speed is greater than 275 mm/sec, it is possible at each processing speed to employ a charging unit having a case width that is suited thereto. Accordingly, it is possible to reduce the amount of ozone produced as compared with that produced by the constitution of the foregoing third embodiment, i.e., the situation in which two charging units 5, 5 having identical configuration are driven in parallel (two charging units having case widths of 14 mm are driven in parallel).

The present invention may be utilized to good effect in electrophotographic image forming apparatuses capable of being employed in copiers, laser printers, facsimile machines, and the like; and in particular, in image forming apparatuses of the type in which corona-type charging unit(s) or other such charging unit(s) is/are used to charge photosensitive body surface(s).

Moreover, the present invention may be embodied in a wide variety of forms other than those presented herein without departing from the spirit or essential characteristics thereof. The foregoing embodiments, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. An electrophotographic image forming apparatus which is capable of carrying out one or more image forming processes setting at a plurality of processing speeds and equipped with means for selectively switching between or among the processing speeds, the apparatus comprising:

one or more image forming units, in at least one of which a plurality of charging units having mutually identical configurations are arranged, wherein each of the plurality of charging units is respectively provided with a separate high-voltage power supply, switching at a low-voltage primary side of any one of the high-voltage power supplies causing a high-voltage output to the corresponding charging unit to be controlled in ON/OFF fashion.

2. An electrophotographic image forming apparatus which is capable of carrying out one or more image forming processes setting at a plurality of processing speeds and equipped with means for selectively switching between or among the processing speeds, the apparatus comprising:

one or more image forming units, in at least one of which a plurality of charging units having mutually identical configurations are arranged, wherein:

when driving at least a portion of the charging units, the number of the charging units to be driven is switched in correspondence to processing speed; and each of the plurality of charging units is respectively provided with a separate high-voltage power supply, switching at a low-voltage primary side of any one of the high-voltage power supplies causing a high-voltage output to the corresponding charging unit to be controlled in ON/OFF fashion.

3. An electrophotographic image forming apparatus which is capable of carrying out one or more image forming processes setting at a plurality of processing speeds and equipped with means for selectively switching between or among the processing speeds, the apparatus comprising:

one or more image forming units, in at least one of which a plurality of charging units having mutually identical configurations are arranged, wherein:

at least a portion of the charging units is versatile enough to be used in at least one other model of image forming apparatus; and each of the plurality of charging units is respectively provided with a separate high-voltage power supply, switching at a low-voltage primary side of any one of the high-voltage power supplies causing a high-voltage output to the corresponding charging unit to be controlled in ON/OFF fashion.

4. An electrophotographic image forming apparatus, which is p1 capable of carrying out one or more image forming processes setting at a plurality of processing speeds and equipped with means for permitting selectively switching between or among the processing speeds, the apparatus comprising:

at least one first charging unit versatile enough to be used in at least one other model of image forming apparatus; and at least one second charging unit having at least one configuration different from at least one configuration of at least one of the first charging unit or units, driving of at least one of the first charging unit or units and/or at least one of the second charging unit or units being switched in correspondence to at least one processing speed.

5. An image forming apparatus according to claim 4 wherein:

at least one of the second charging unit or units is versatile enough to be used in at least one other model of image forming apparatus.

6. An image forming apparatus according to any of claims 1-3, 4, and 5 wherein:

at least one of the charging unit or units is a corona-type charging unit.

* * * * *